US008888520B2

(12) United States Patent
Umemura

(10) Patent No.: US 8,888,520 B2
(45) Date of Patent: Nov. 18, 2014

(54) CONTACT WITH PAIR OF PINS EACH WITH A FOLDED END

(75) Inventor: Yuji Umemura, Tokyo (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 334 days.

(21) Appl. No.: 13/530,972

(22) Filed: Jun. 22, 2012

(65) Prior Publication Data

US 2012/0329338 A1 Dec. 27, 2012

(30) Foreign Application Priority Data

Jun. 22, 2011 (JP) ..... 2011-138572

(51) Int. Cl.
*H01R 13/28* (2006.01)
*H01R 13/24* (2006.01)

(52) U.S. Cl.
CPC ..... *H01R 13/2421* (2013.01)
USPC ..... 439/284

(58) Field of Classification Search
USPC ..... 439/74, 283–284
See application file for complete search history.

(56) References Cited

U.S. PATENT DOCUMENTS

| | | | | |
|---|---|---|---|---|
| 5,520,545 | A * | 5/1996 | Sipe | 439/65 |
| 5,921,787 | A * | 7/1999 | Pope et al. | 439/74 |
| 6,074,230 | A * | 6/2000 | Comerci et al. | 439/284 |
| 7,025,602 | B1 | 4/2006 | Hwang | |
| 7,972,184 | B2 * | 7/2011 | Hsieh et al. | 439/700 |
| 8,262,419 | B2 * | 9/2012 | Chen et al. | 439/700 |
| 8,460,010 | B2 * | 6/2013 | Kimura et al. | 439/66 |
| 8,523,579 | B2 * | 9/2013 | Johnston et al. | 439/66 |

FOREIGN PATENT DOCUMENTS

| | | |
|---|---|---|
| JP | 2000-150091 | 5/2000 |

* cited by examiner

*Primary Examiner* — Chandrika Prasad
(74) *Attorney, Agent, or Firm* — Barley Snyder

(57) ABSTRACT

The invention is embodied in a contact that is fixed in a housing of a socket to be connected with an electronic component and makes a contact with an electrical contact of the electronic component. The contact has a pair of contact pins and a spring member. Each of the contact pins includes a straight section approximately straightly extending from a first end section to a second end section, and are coupled with each other in an attitude in which the first end section is respectively oriented to the second end section and the respective straight sections overlap with each other, and each of the contact pins includes a clip section being folded back in a curve from the second end section to cooperate with the second end section to pinch the first end section of a counterpart therebetween. The spring member surrounds both of the straight sections of the pair of contact pins and gives a force in a direction in which the clip sections of the pair of contact pins are moved away from each other.

7 Claims, 6 Drawing Sheets

CONTACT WITH PAIR OF PINS EACH WITH A FOLDED END

CROSS-REFERENCE TO RELATED APPLICATIONS

This application claims the benefit of the filing date under 35 U.S.C. §119(a)-(d) of Japanese Patent Application No. 2011-138572, filed Jun. 22, 2011.

FIELD OF THE INVENTION

The invention relates to electrical connectors and more particularly to an electrical contact and a socket.

BACKGROUND

Among sockets for making contact with an electronic component such as an IC and a circuit board, there is a type which includes a contact to resiliently contact an electrical contact of the electronic component. There is known, for example, a contact in which an upper contact pin and a lower contact pin are movably accommodated in a tubular main body, and a coil spring is arranged between the upper contact pin and the lower contact pin. In order to manufacture the contact, first, the upper contact pin, the lower contact pin and the coil spring are inserted in the main body. Subsequently, in order to prevent the upper contact pin and the lower contact pin from falling off, both ends of the tubular main body are deformed to be slimmer. Such a process requires additional steps and leads to the high cost of manufacturing.

Japanese Patent Publication JP 2008-516398A illustrates a contact for an electronic device, the contact including an upper contact pin, a lower contact pin and a spring. The upper contact pin and the lower contact pin are manufactured by processing a thin plate, and have the same shape as each other. Each of the upper contact pin and the lower contact pin includes a hook extending in a bifurcated manner. The upper contact pin and the lower contact pin are orthogonal to each other, so that the bifurcated hook of each pinches the mating contact pin to couple with each other. The spring is arranged to surround a potion where the upper contact pin and the lower contact pin couple with each other, and gives a force in a direction in which the upper contact pin and the lower contact pin move away from each other. When a force is applied from both ends of the contacts, the upper contact pin and the lower contact pin move away from each other while elastically deforming the spring.

Shapes of the bifurcated hooks in the upper contact pin and the lower contact pin of Japanese Patent Publication JP 2008-516398A are made by stamping a thin plate. In other words, surfaces of the hooks for pinching the mating contact pin are sheared surfaces formed by the stamping, that is, they are rough surfaces. Accordingly, the reliability of making contact with the mating contact pin is diminished.

SUMMARY

The invention has been made in view of the above circumstances and provides a contact and a socket which may be readily manufactured and have high reliability.

The invention is related to a contact that is fixed in a housing of a socket to be connected with an electronic component and makes contact with an electrical contact of the electronic component. The contact has a pair of contact pins and a spring member. Each of the contact pins includes a straight section approximately straightly extending from a first end section to a second end section. The contact pins are coupled with each other in an attitude in which the first end section is respectively oriented to the second end section and the respective straight sections overlap with each other. Each of the contact pins includes a clip section being folded back in a curve from the second end section to cooperate with the second end section to pinch the first end section of a counterpart therebetween. The spring member surrounds both of the straight sections of the pair of contact pins and applies a force in a direction in which the clip sections of the pair of contact pins are moved away from each other.

BRIEF DESCRIPTION OF THE DRAWINGS

The invention is described in more detail below with reference to the embodiments shown in the drawings. Similar or corresponding details in the Figures are provided with the same reference numerals. The invention will be described in detail with reference to the following figures of which.

DETAILED DESCRIPTION OF THE EMBODIMENT(S)

An exemplary embodiment according to the invention will be described with reference to the drawings.

Figure 1:
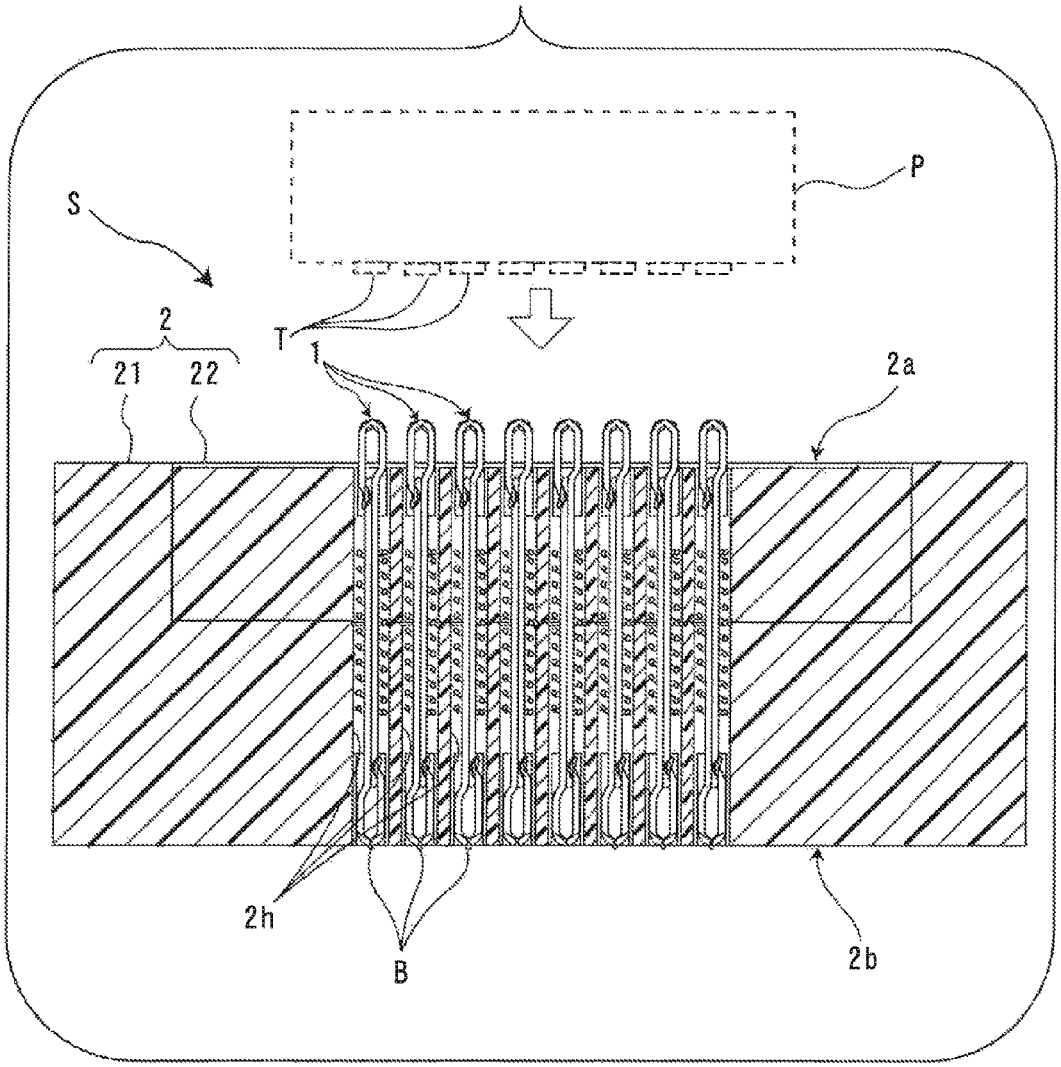
FIG. 1 is a cross-sectional view illustrating an exemplary embodiment of a socket according to the invention.

The socket S illustrated in FIG. 1 is mounted, for example, on a circuit board which is not illustrated, and is connected with an electronic component P, thereby electrically connecting the electronic component P with the circuit board. The electronic component P may be, for example, an Integrated circuit (IC) such as a ball grid array (BGA) in which electrical contacts T are two-dimensionally arranged. However, a target to be connected with the socket S is not limited to an IC, and also includes, for example, a circuit board having an electrical contact.

The socket S includes exemplary contacts 1 for making contact with the electrical contacts T of the electronic component P and a housing 2 which holds the contacts 1. The housing 2 is formed of an insulating material. The housing 2 includes a receiving surface 2*a* for receiving the electronic component P and a board surface 2*b* opposite to the receiving surface 2*a*. The socket S is mounted on a circuit board which is not illustrated while the board surface 2*b* faces the circuit board. Contact receiving passageways 2*h* extending from the receiving surface 2*a* to the board surface 2*b* are arranged in the housing 2.

The contacts 1 are located in the contact receiving passageways 2*h*. The plural contacts 1 are arranged in the socket S. One row of the arranged contacts 1 is illustrated in FIG. 1, and the contacts 1 are arranged in plural rows and plural columns when viewed in a plan view of the receiving surface 2*a*.

Each of the contacts 1 extends through the housing 2. One end of each contact 1 is exposed on the board surface 2*b*, and other end of each contact 1 is exposed on the receiving surface 2*a*. More specifically, the length of each of the contacts 1 is larger than a thickness from the receiving surface 2*a* to the board surface 2*b* of the housing 2 as illustrated in FIG. 1. For this reason, the contacts 1 protrude from the receiving surface 2*a* of the housing 2. In addition, solder balls B for connecting to a circuit board which is not illustrated are attached to the ends exposed on the board surface 2*b* of the contacts 1. However, the socket S is not limited to one for a soldered connection with a circuit board, and may be one in which the housing 2 is pressed against a circuit board to be fixed so that the ends exposed on the board surface 2*b* of the contacts 1 make contact with the circuit board.

Each of the contacts 1 includes a telescopic configuration independently from the other contacts. When the electronic component P is connected, the electronic component P is pressed toward the receiving surface 2*a* of the housing 2. At this time, the ends of the contacts 1 which protrude from the receiving surface 2*a* of the housing 2 make contact with the electrical contacts T of the electronic component P, and are pressed toward the housing 2 by the electrical contacts T. The contacts 1 resiliently contact the electrical contacts T of the electronic component P, respectively. In other words, each of the contacts 1 resiliently engages each of the electrical contacts T with a reactive force when the contacts 1 are urged against the electrical contacts T. Accordingly, each of the contacts 1 accommodates any deviations in planarity of the electronic component P and dimensional tolerances of each of the electrical contacts T, to make contact with each of the electrical contacts T with an appropriate contact force.

Figure 2:
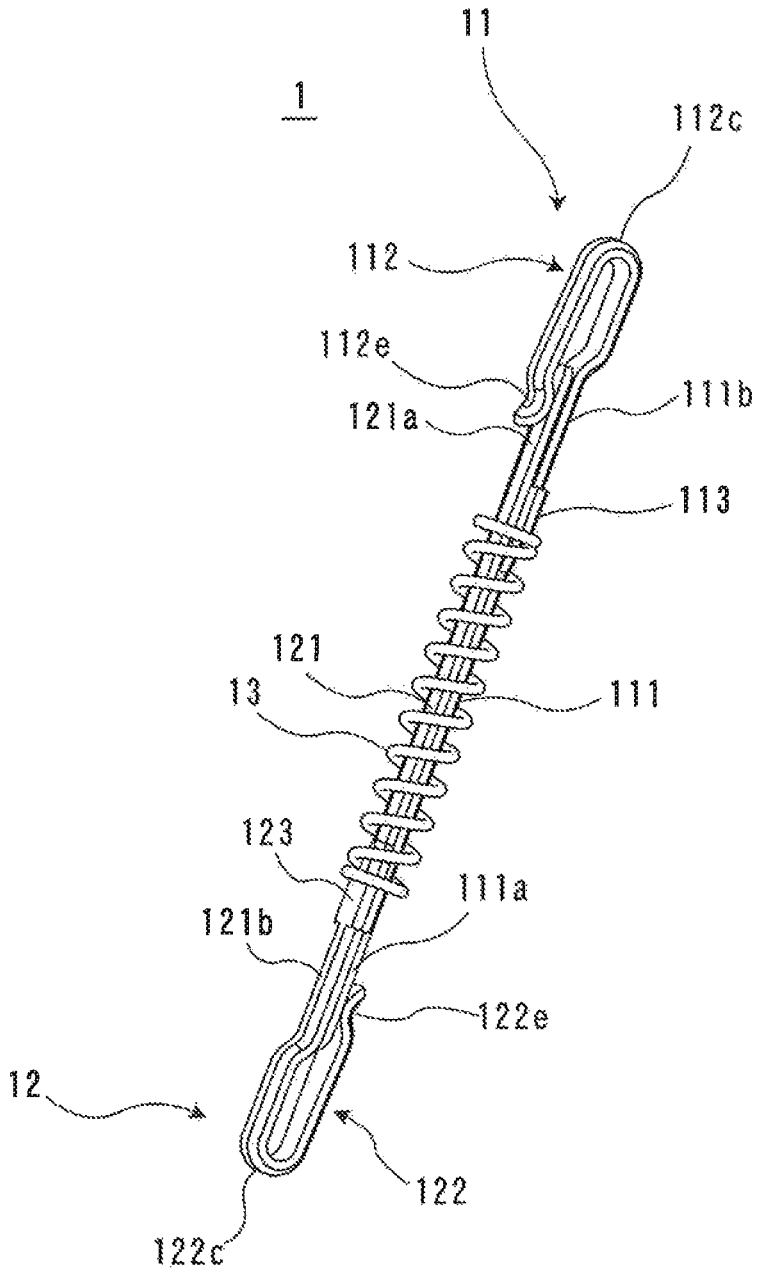
FIG. 2 is a perspective view illustrating a contact illustrated in FIG. 1.
Figure 3:
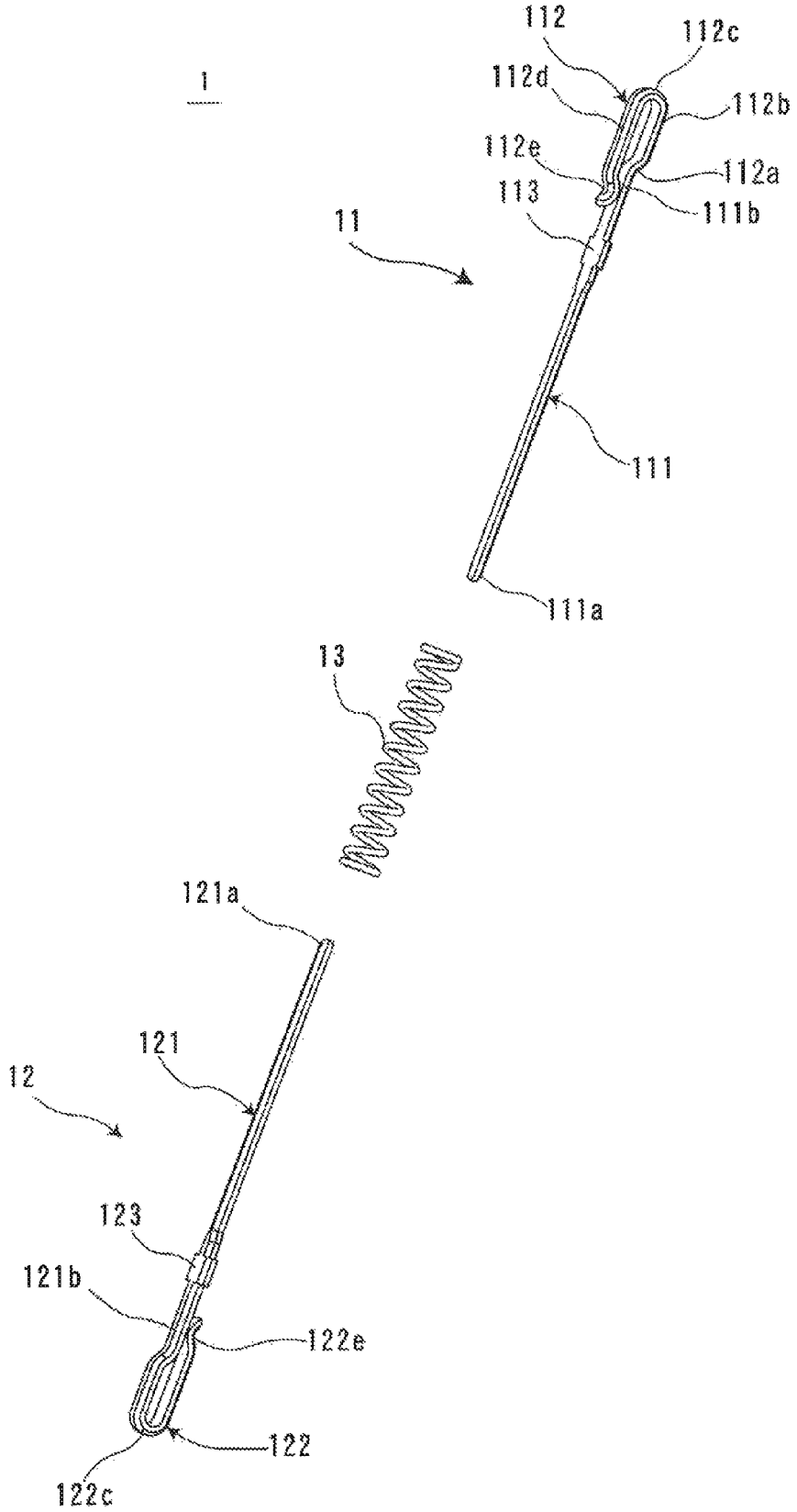
FIG. 3 is an exploded perspective view of the contact illustrated in FIG. 2.

The contact 1 illustrated in FIGS. 2 and 3 includes a pair of contact pins 11, 12 and a spring member 13.

The first contact pin 11 includes a straight section 111 and a clip 112 being continuous with the straight section 111.

The straight section 111 extends from a first end section 111*a* toward a second end section 111*b*. A wider section 113 which is wider than a remaining portion is provided between the first end section 111*a* and the second end section 111*b* in the straight section 111, more specifically, close to the second end section 111*b*.

The clip 112 is a portion to make contact with one of the electrical contacts T of the electronic component P, in the socket S as shown in FIG. 1. The clip 112 is curved from the second end section 111*b* and folded back. An arcuate section 112*c* bulged toward the second end section 111*b* is provided at a tip up to which the clip 112 extends after being curved from the second end section 111*b*. The clip 112 includes, more specifically, as illustrated in FIG. 3, an inclined section 112*a*, a first extension section 112*b*, a folded back section 112*c*, a second extension section 112*d* and the arcuate section 112*e*.

The inclined section 112*a* obliquely extends from the second end section 111*b* of the straight section 111. The first extension section 112*b* continuously extends from the inclined section 112*a* in a same direction as the straight section 111. The folded back section 112*c* continues from the first extension section 112*b* and is curved to be folded back at approximately 180 degrees. The second extension section 112*d* continues from the folded back section 112*c* and extends in parallel with the first extension section 112*b*. The arcuate section 112*e* continues from the second extension section 112*d* and is curved in an arc shape to bulge toward the second end section 111*b* of the straight section 111.

A space between a portion of the arcuate section 112*e* bulged toward the second end section 111*b* and the second end section 111*b* is smaller than the thickness of the contact pin 11 in a state illustrated in FIG. 3 where there is no intermediate object and no external force. For example, the space between the arcuate section 112*e* and the second end section 111*b* may be zero. In other words, the arcuate section 112*e* may be contacted with the second end section 111*b*.

The clip 112 includes a curve to be folded back, and makes contact with the electrical contacts T as shown in FIG. 1 by an outer curved surface of the curve. More specifically, the clip 112 makes contact with the electrical contacts T as shown in FIG. 1 by the curved surface on an outer side of the folded back section 112*c* as shown in FIG. 3 curved to be folded back. Accordingly, damage to the electrical contacts T is prevented and the reliability of contacting with the electrical contacts T is improved.

The pair of contact pins 11, 12 according to the present embodiment have the same shape as each other. In other words, the second contact pin 12 also includes a straight section 121 straightly extending from a first end section 121*a* toward a second end section 121*b*, and a clip 122 curved from the second end section 121*b* to be folded back. In addition, the second contact pin 12 includes a wider section 123 and an arcuate section 122*e*. A folded back section 122*c* of the clip 122 in the second contact pin 12 is connected to a circuit board which is not illustrated.

As illustrated in FIG. 2, in the first contact pin 11 and the second contact pin 12, the first end section 111*a*, 121*a* are coupled in an attitude in which the first end section 111*a*, 121*a* is oriented to the second end section 121*b*, 111*b* of each counterpart, respectively, and the straight sections 111, 121 are overlapped with each other. The straight sections 111, 121 make contact with each other across most of their lengths.

The clip 112 of the first contact pin 11 and the second end section 111*b* pinch the first end section 121*a* of the second contact pin 12 therebetween. On the other hand, the clip 122 of the second contact pin 12 and the second end section 121*b* pinch the first end section 111*a* of the first contact pin 11 therebetween. More specifically, the arcuate section 112*e* of the clip 112 of the first contact pin 11 and the second end section 111*b* pinch the first end section 121*a* of the second contact pin 12 therebetween. On the other hand, the arcuate section 122*e* of the clip 122 of the second contact pin 12 and the second end section 121*b* pinch the first end section 111*a* of the first contact pin 11 therebetween.

The straight section 121, more specifically, the first end section 121*a* of the straight section 121 is inserted, so that the clip 112 of the first contact pin 11 is elastically deformed in a direction away from the second end section 111*b*. The clip 112 and the second end section 111*b* pinch the straight section 121 of the second contact pin 12 resiliently. This is also applied to the clip 122 of the second contact pin 12.

The first contact pin 11 and the second contact pin 12 are formed by stamping and forming a conductive metal plate.

In the first contact pin 11, the clip 112 pinching the straight section 121 of the second contact pin 12 is formed by bending the stamped metal plate to be folded back with respect to the straight section 121. For this reason, in the straight section 111 and the clip 112 of the first contact pin 11, the portion pinching the straight section 121 of the second contact pin 12 is formed not by a sheared surface but by a planar surface of the metal plate. This is also applied to the straight section 121 and the clip 122 of the second contact pin 12.

The spring member 13 is a coil spring having a helical shape. The spring member 13 surrounds both of the straight sections 111, 121 of the pair of contact pins 11, 12. The wider sections 113, 123 respectively included in the pair of contact pins 11, 12 have widths larger than an inner diameter of the spring member 13. For this reason, ends of the spring member 13 are prevented from going through by the wider sections 113, 123. The spring member 13 is a compression spring. In other words, the spring member 13 gives a force in a direction in which the clip 112, 122 of both contact pins 11, 12 are urged away from each other.

In addition, the wider sections 113, 123 also prevent the contact pins 11, 12 from passing through the contact passageways of the housing 2 as shown in FIG. 1. In the contact receiving passageways 2*h* of the housing 2 illustrated in FIG. 1, both ends opening on the receiving surface 2*a* and the board surface 2*b* are formed narrower than the wider sections 113, 123 of the contact pins 11, 12. For this reason, the contact pins 11, 12 are secured in the housing 2. Incidentally, the housing 2 illustrated in FIG. 1 includes two members of a lower member 21 and an upper member 22, and the contact receiving passageways 2*h* extend through both of the lower member 21 and the upper member 22. When assembled, the contacts 1 are inserted into the contact receiving passageways 2*h* in a state in which the lower member 21 is detached from the upper member 22. Subsequently, the lower member 21 is coupled with the upper member 22, so that the contacts 1 are received in the housing 2.

In the contact 1 illustrated in FIG. 2 is held by the housing 2 as shown in FIG. 1, the clip 122 of the second contact pin 12 is connected to the circuit board which is not illustrated, and the clip 112 of the first contact pin 11 is urged against the electrical contact T of the electronic component P as shown in FIG. 1. At this time, the first contact pin 11 and the second contact pin 12 of the contact 1 move(or slide) in a direction in which the length of the contact 1 is reduced, in other words, a direction in which the clips 112, 122 approach to each other. The clip 112 of the first contact pin 11 and the second end section 111*b* pinch the straight section 121 of the second contact pin 12 therebetween resiliently, and the clip 122 of the second contact pin 12 and the second end section 121*b* pinch the straight section 111 of the first contact pin 11 therebetween resiliently. Accordingly, each of the straight sections 111, 121 smoothly slides while making contact with each of the counterpart contacts by the elastic force. Thus, such curved shapes for making contact in the curved surfaces with the circuit board (which is not illustrated) and the electrical contacts T as shown in FIG. 1 of the electronic component P are also used for holding the straight sections 121, 111 of the counterpart contact pins 12, 11.

Here, the straight section 121 and the clip 112 of the first contact pin 11 make contact, not by sheared surfaces but by the planar surfaces of the metal plate as, with the straight section 121 of the second contact pin 12. Accordingly, portions making contact are smooth, and thus the reliability of contact is high and damage is minimized. This is also applied to the straight sections 121 and the clip 122 of the contact pin 12 which pinch the straight section 111 of the first contact pin 11.

Further, curved surfaces formed in the arcuate sections 122*e*, 112*e* of the clips 122, 112 make contact with the straight sections 111, 121, respectively. For this reason, the straight sections 111, 121 smoothly slide and damage is prevented.

As the first contact pin 11 and second contact pin 12 move, the spring member 13 supported by the wider section 113 of the first contact pin 11 and the wider section 123 of the second contact pin 12 is compressed. By compression of the spring members 13, the first contact pins 11 engages an electrical contact T as shown in FIG. 1. Accordingly, favorable contact is retained between the first contact pin 11 and the electrical contact T.

Forming of the pair of contact pins 11, 12 is described below.

As described above, the first contact pins 11 are formed by stamping and forming a conductive metal plate.

More specifically, in forming the first contact pins 11, first, a metal plate is stamped. Edges of surfaces opposite to pressed surfaces, with burrs are chamfered. Next, portions to be the clip 112 are curved by the forming such that the surfaces of the chamfered edges face outward, and thus the portions to be the clips 112 are formed. In addition, at the same time, or before or after this step, the arcuate sections 112*e* and the other portions are formed.

Figure 4:
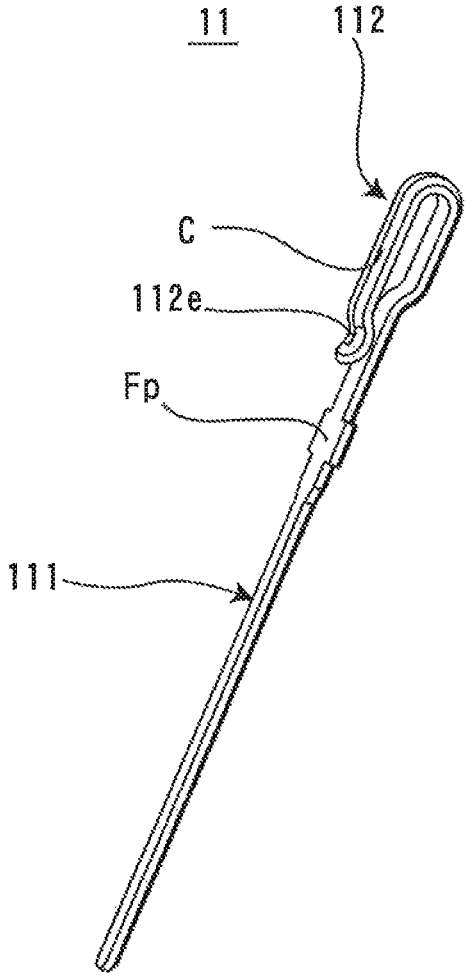
FIG. 4 is an enlarged perspective view illustrating a first contact pin illustrated in FIG. 3.

Through these processes, in the first contact pins 11, surfaces of the straight sections 111 which overlap with the straight sections 121 of the second contact pins 12 as shown in FIG. 4 become pressed surfaces Fp, and a chamfer C is applied to both side edges of surfaces opposite to these surfaces, i.e., surfaces with burrs Fb. The chamfer C of the both side edges also continues to the clips 112. In other words, in the clips 112, the chamfer C is applied to the both side edges of the surfaces with burrs Fb which face outward in the curves.

Figure 5:
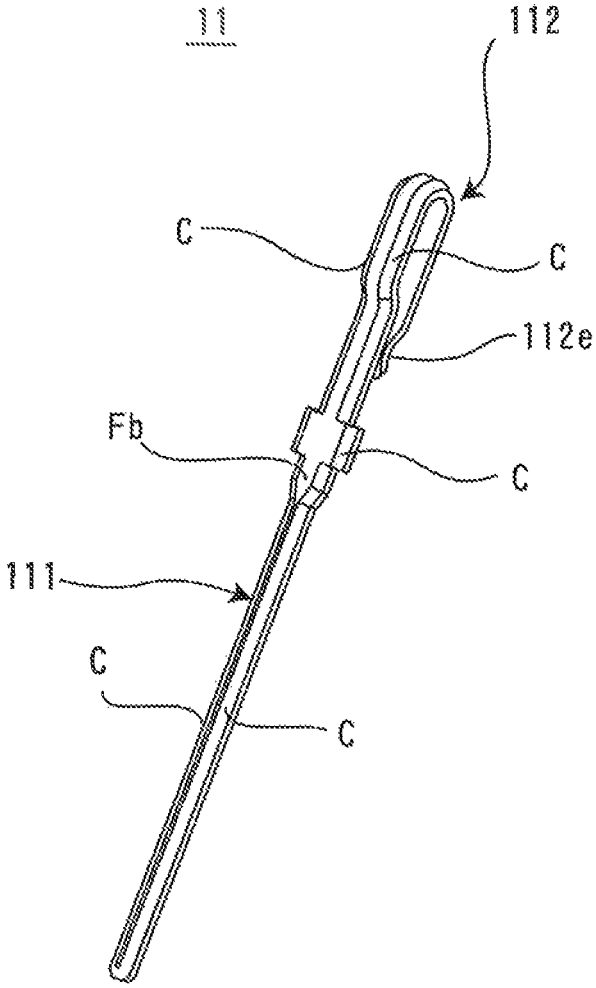
FIG. 5 is a perspective view of the first contact pin viewed from another angle.
Figure 6:
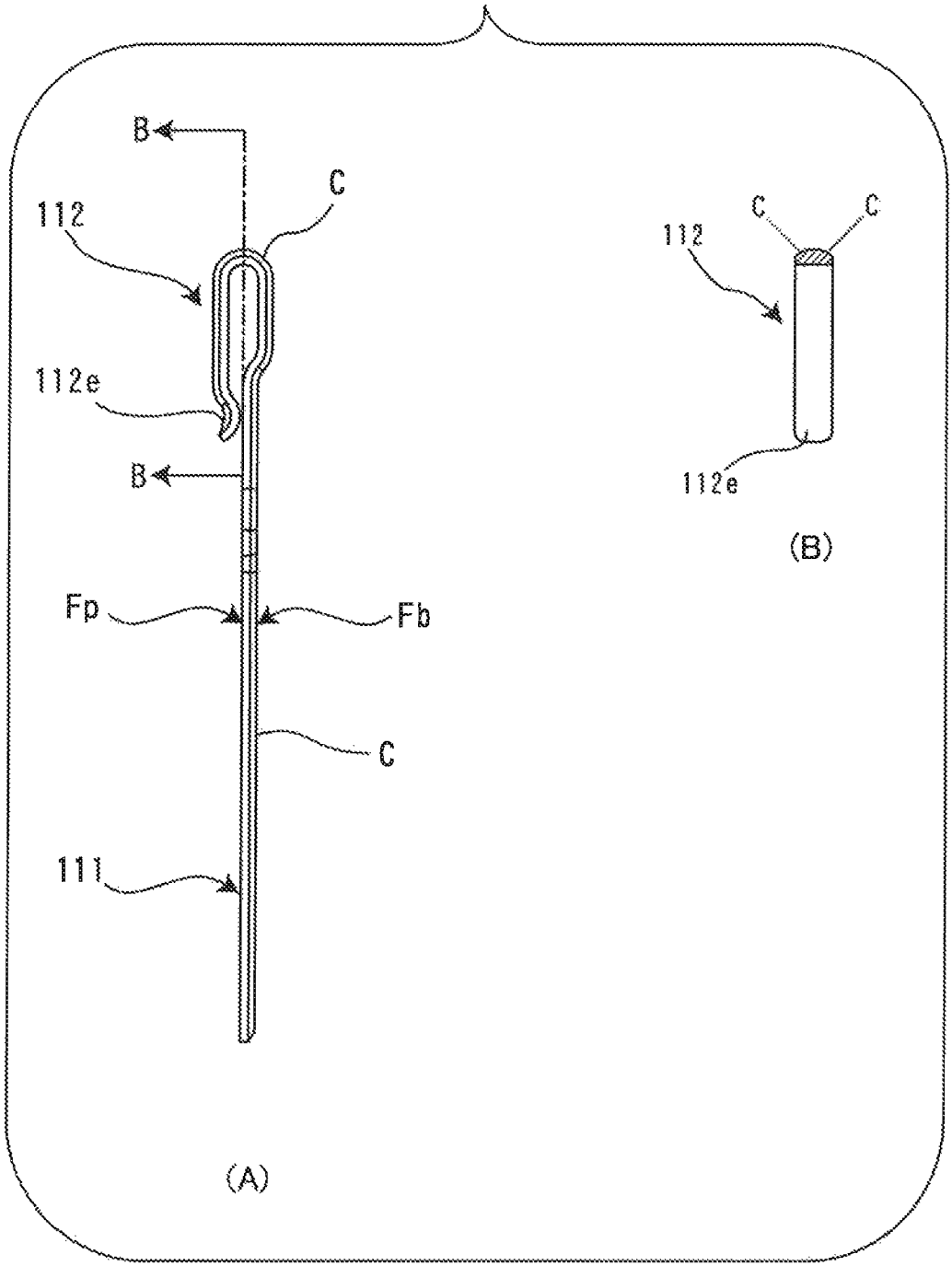
FIG. 6A is a side view of the first contact pin.
FIG. 6B is a cross-sectional view of the first contact pin.

Shapes of the second contact pins 12 as shown in FIGS. 2 and 3 are same as those of the first contact pins 11 illustrated in FIGS. 4 and 5.

The chamfer C is applied to the both side edges of the surfaces with burrs Fb which are the surfaces opposite to the surfaces of the straight sections 111 which overlap with the straight sections 121 of the second contact pins 12 as shown in FIG. 3. In other words, as illustrated in FIG. 2, all of four edges facing outward in the state in which the two straight sections 111, 121 overlap with each other are chamfered. These portions are to be surrounded by the spring member 13. Accordingly, compared to a case without chamfering, it is possible to downsize a diameter of the spring members 13. In addition, removal of burrs prevents hooking of the spring members 13.

In addition, in the clips 112, the chamfer C is applied to the both side edges of the surfaces with burrs Fb which face outward in the curves. In other words, all of the four edges are chamfered, the four edges facing outward in portions of the clips 112 in which portions the first extension sections 112*b* and the second extension sections 112*d* as shown in FIG. 3 are parallel with each other. Accordingly, an outer diameter of the clips 112 is downsized.

As described above, the diameter of the spring members 13 is downsized, and in addition, the diameter in the clips 112 are also downsized, and thus it is possible to downsize the contact holes of the housing 2 as shown in FIG. 1. Accordingly, it is possible to make the contacts 1 arranged in a fine-pitch manner in the socket S as shown in FIG. 1.

In addition, in the first contact pins 11, the sides of the straight sections 111 in which sides the first contact pins 11 respectively overlap with the straight sections of the second contact pins 12 as shown in FIG. 3 are the pressed surface Fp. Accordingly, as illustrated in FIG. 2, on the surfaces on which the straight sections 111 and 121 respectively overlap with each other, there is no burr produced in the both edges thereof by the stamping. Rather, so called sags by digging of a cutting edge are produced on the pressed surfaces Fp, and the edges have blunt shapes. Accordingly, sliding between the straight sections 111 and 121 is smooth. Further, the burrs produced on the sides opposite to the pressed surfaces Fp are removed by the chamfering described above.

Incidentally, in the embodiment described above, the first contact pins 11 and the second contact pins 12 which have the same shape as each other are illustrated as an example of the pair of contact pins according to the invention. However, the invention is not limited to this. For example, the pair of contact pins may include portions whose shapes are not same with each other.

Furthermore, the socket S according to the embodiment described above includes eight contacts in one row. However, the invention is not limited to this. A socket may include plural contacts, for example, seven or less contacts in one row or nine or more contacts in one row.

What is claimed is:

1. A contact, comprising:

a pair of contact pins each including a straight section approximately straightly extending from a first end section to a second end section, which are coupled with each other in an attitude in which the first end section is respectively oriented to the second end section and the respective straight sections overlap with each other, and each of which includes a clip being folded back in a curve from the second end section to cooperate with the second end section to pinch the first end section of a counterpart therebetween; and a spring member which surrounds both of the straight sections of the pair of contact pins and urges the clips away from each other.

2. The contact according to claim 1, wherein each clip includes an arcuate section bulged toward the second end section at a position in which the clip and the second end section pinch the first end section of the counterpart.

3. The contact according to claim 1, wherein each of the pair of contact pins is formed through stamping and chamfering both edges of a surface opposite to a surface on a side overlaped with the straight sections.

4. The contact according to claim 1, wherein the pair of contact pins are stamped in a direction in which the side of the surface of the straight sections overlap with each other.

5. The contact according to claim 1, wherein each of the pair of contact pins includes a wider section near the second end section of the straight section, the wider section being formed wider than a remaining portion of the straight section to prevent one end of each of the spring members from going through.

6. A socket that is connected to an electronic component, comprising:

a housing; and a contact fixed in the housing and being contactable with an electrical contact of the electronic component, wherein the contact includes:

a pair of contact pins each including a straight section approximately straightly extending from a first end section to a second end section, which are coupled with each other in an attitude in which the first end section is respectively oriented to the second end section and the respective straight sections overlap with each other, and each of which includes a clip being folded back in a curve from the second end section to cooperate with the clip to pinch the first end section of a counterpart therebetween; and a spring member which surrounds both of the straight sections of the pair of contact pins and urges the pair of contact pins away from each other.

7. A socket according to claim 6, wherein the housing comprises two members, the contact being fixed in both of the two members.

* * * * *